US012276472B2

(12) United States Patent
Whitney et al.

(10) Patent No.: US 12,276,472 B2
(45) Date of Patent: Apr. 15, 2025

(54) SHOTGUN BREECH RELEASE

(71) Applicant: Xisico USA, Inc., Katy, TX (US)

(72) Inventors: Travis W. Whitney, Brookings, OR (US); Charles Twigg, Houston, TX (US); Dennis Lam, Katy, TX (US); David Ostrosky, Katy, TX (US)

(73) Assignee: XISICO USA, Inc, Katy, TX (US)

( * ) Notice: Subject to any disclaimer, the term of this patent is extended or adjusted under 35 U.S.C. 154(b) by 58 days.

(21) Appl. No.: 18/497,098

(22) Filed: Oct. 30, 2023

(65) Prior Publication Data

US 2024/0151482 A1 May 9, 2024

Related U.S. Application Data

(60) Provisional application No. 63/382,321, filed on Nov. 4, 2022.

(51) Int. Cl.
*F41A 11/00* (2006.01)
*F41A 3/72* (2006.01)

(52) U.S. Cl.
CPC ..... *F41A 3/72* (2013.01); *F41A 11/00* (2013.01)

(58) Field of Classification Search
CPC ..... F41A 11/00; F41A 3/66; F41A 3/72
See application file for complete search history.

(56) References Cited

U.S. PATENT DOCUMENTS

| | | | | |
|---|---|---|---|---|
| 10,018,436 | B1 * | 7/2018 | Cross | F41A 11/00 |
| 10,126,078 | B1 * | 11/2018 | Harris | F16B 21/125 |
| 10,267,584 | B2 * | 4/2019 | Kasanjian-King | F41A 3/66 |
| 10,704,851 | B1 * | 7/2020 | Redillo | F41A 17/42 |
| 2019/0049207 | A1 * | 2/2019 | Kasanjian-King | F41A 17/38 |
| 2020/0033081 | A1 * | 1/2020 | Kasanjian-King | F41A 11/00 |
| 2020/0208930 | A1 * | 7/2020 | Redillo | F41A 3/72 |
| 2020/0300564 | A1 * | 9/2020 | Kasanjian-King | F41A 17/38 |
| 2023/0384046 | A1 * | 11/2023 | Kasanjian-King | F41A 11/00 |

* cited by examiner

*Primary Examiner* — Jonathan C Weber
(74) *Attorney, Agent, or Firm* — Xinsheng Wang; USCIPC

(57) ABSTRACT

A breech release for a shotgun includes a push button, a return spring, a spring retainer, a threaded steel rod, and a release slide. the return spring is located between the push button and spring retainer. when the breech release engages with a breech, the breech release bisects an outer breech which hinged an inner breech, holding the breech closed in its default position. When the button is depressed, the button moves the slide out of the inner breech, allowing the breech to open.

6 Claims, 5 Drawing Sheets

SHOTGUN BREECH RELEASE

CROSS-REFERENCE TO RELATED APPLICATIONS

This application claims the benefit to U.S. Provisional Application No. 63/382,321 filed on Nov. 4, 2022, the contents of which are incorporated by reference in its entirety.

FIELD

The inventions described below relates generally to firearms, and in particular to a breech release for a shotgun.

BACKGROUND OF THE INVENTION

Conventional shotguns have been popular among sportsmen for hunting and sport shooting (e.g., of clay pigeons), and have various uses ranging from home defense to law enforcement applications. For example, JTS-M12AR-gauge shotgun is a semi-auto AR-style 12 GA shotgun. Several rounds of ammunition are stored in a spring-loaded magazine. The magazine includes a housing in which the rounds are stored and held until needed. The housing includes an open top which is dimensioned and configured to feed the rounds of ammunition smoothly into the receiver of the corresponding firearm. The outer dimensions of the housing are configured to matingly and releasably engage a corresponding magazine bay and magazine locking/releasing mechanism of a corresponding firearm. Disposed inside the housing, and anchored at the bottom of the magazine, is spring that is biased to urge the rounds of ammunition toward the top of the magazine. In this fashion, as the top-most round in the magazine is extracted and fired (by the action of the firearm), a new round is urged into the top-most position and is ready to be loaded into the receiver of the firearm.

In some jurisdictions, a semi-automatic firearm is prohibited to the general public when it is equipped with a conventional detachable box magazine that enables rapid reloading. For example, California now requires magazines to be removable only after opening the action of the firearm, this creates problems for many firearms such as JTS-M12AR-gauge shotgun.

Therefore, a need exists for a new and improved design to help shooters reload magazine faster without breaking the law.

SUMMARY OF THE INVENTION

In accordance with the teachings of the present invention, a breech release for a shotgun is provided. The breech release includes a push button, a return spring, a spring retainer, a threaded steel rod, and a release slide. the return spring is located between the push button and spring retainer.

In a preferred embodiment, the release slide has a stepped cylindrical bolted structure, and the spring retainer has a stepped cylindrical bolted structure. when the breech release engages with a breech, the breech release bisects an outer breech which hinged an inner breech, holding the breech closed in its default position. When the button is depressed, the button moves the slide out of the inner breech, allowing the breech to open.

The device is intended to open the breech of the JTS M12AR-CA shotgun slightly, so the magazine release button is released allowing the magazine to be released. Without the device the Gun must have the breech pin removed and reinstalled every time the magazine is released. This device allows for rapid magazine release and install.

DETAILED DESCRIPTION OF THE INVENTION

It is to be understood that the invention of the present disclosure is not limited to the specific devices, conditions, or parameters of the representative embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

Figure 1:
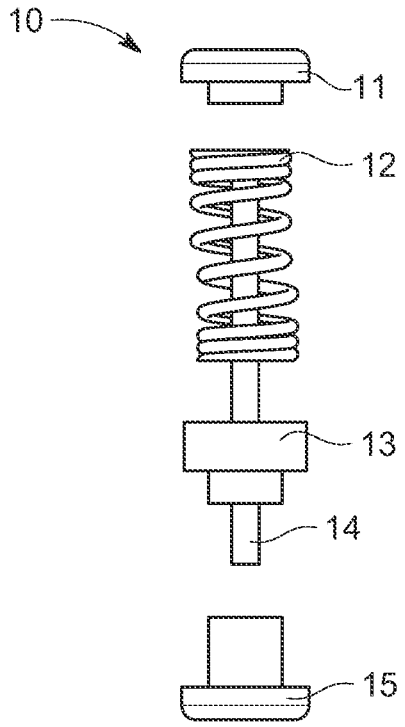
FIG. 1 is an exploded prospective view of a breech release in accordance with an example embodiment.
Figure 2:
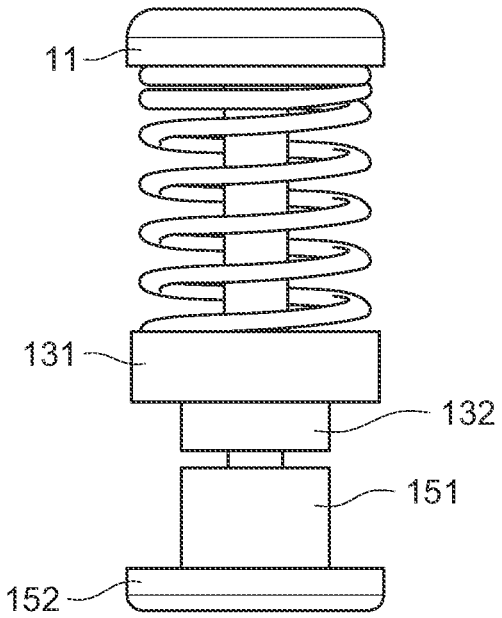
FIG. 2 illustrates a prospective view of the breech release of FIG. 1.
Figure 3:
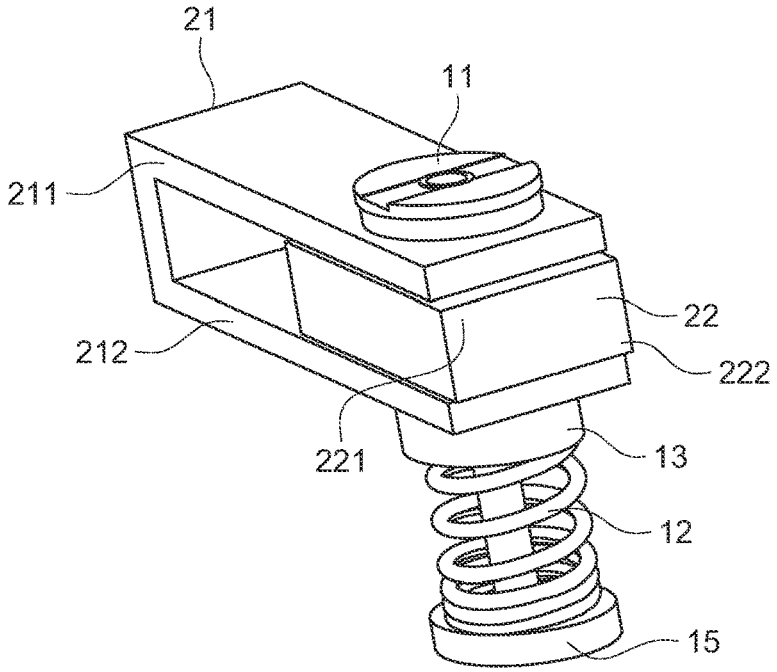
FIG. 3 illustrates a prospective view of the breech release assembled with a breech.
Figure 4:
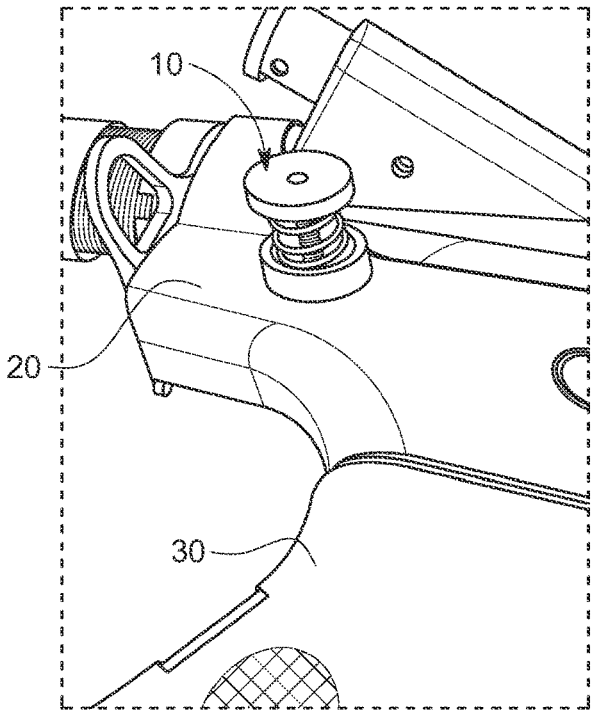
FIG. 4 illustrates one side of a breech release when the breech is closed.
Figure 5:
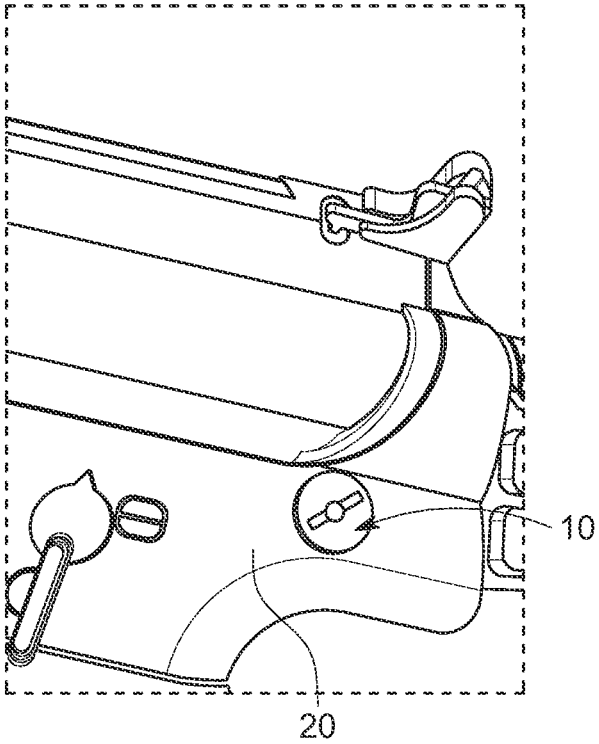
FIG. 5 illustrates the other side of a breech release when the breech is closed.
Figure 6:
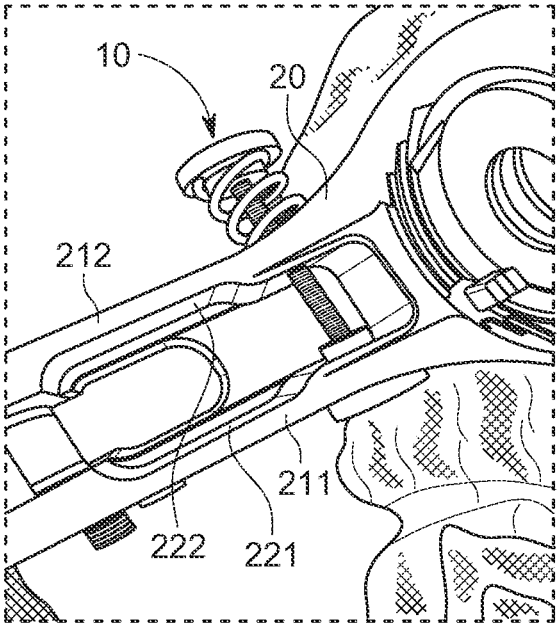
FIG. 6 illustrates how the slide passes through the external breech wall.
Figure 7:
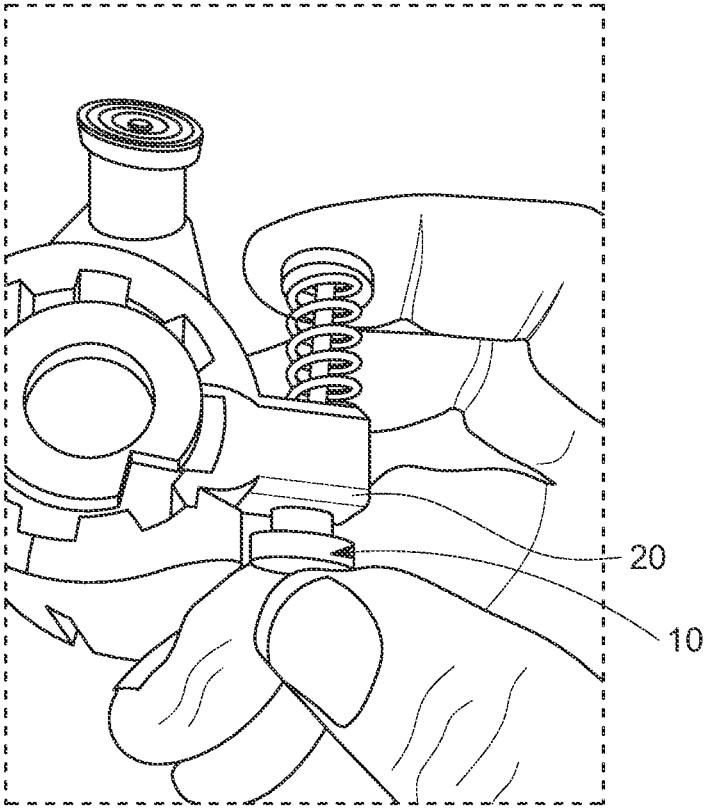
FIG. 7 illustrates an internal view of the slide protruding into the internal breech wall with external breech removed.

Generally described, the present disclosure relates to a breech release which makes a firearm in an inoperable state during the period of reloading magazine. To attain this, the present invention make the breech open slightly when magazine is reloaded. FIGS. 1 and 2 illustrate the breech release 10 for a shotgun of the present invention. The breech release 10 includes a push button 11, a return spring 12, a spring retainer 13, a threaded steel rod 14 and a breech release slide 15.

Two ends of the steel rod 14 are threaded to engage the push button 11 and the slide 15 respectively. The threaded steel rod 14 passes through the return spring 12 and the spring retainer 13 and connects the push button 11 and the slide 15 at two ends thereof. the return spring 12 locates between the push button 11 and the spring retainer 13. The release slide has a stepped cylindrical bolted structure, the diameter of the inner end portion 151 is smaller than that of the outer end portion 152, The release slide further defines a first threaded aperture (not shown) to engage one end of the steel rod, the push button 11 defines a second threaded aperture (not shown) to engage the other end of the steel rod.

The spring retainer also has a stepped cylindrical bolted structure, the diameter of the outer end portion 131 is larger than that of the inner end portion 132. The spring retainer 131 has a thorough aperture (not shown) such that the steel rod 14 can passes through therein.

Referring FIGS. 3-7, the breech 20 of a shot gun comprises mutual separate breech external portion 21 and breech internal portion 22, the breech external portion 21 has two walls 211,212 with each having a hole (not shown), the upper wall 211 has an upper hole and the lower wall 212 has a lower hole. The breech internal portion 22 also has two walls with each having a bore, the upper wall 221 has an upper bore and the lower wall 222 has a lower bore.

When the breech release 10 is assembled, the breech internal portion 22 is located in the breech external portion 21, the upper hole and the lower hole of the breech internal portion 22 are in alignment with the upper bore and the lower bore of the breech external portion 22. The push button 11 is arranged on the bottom end of the steel rod 14, the steel rod 14 passed successively through the return spring 12 and the spring retainer 13 and then passed through the breech external portion 21 and breech internal portion 22 successively form below the breech external portion 21 to the upper wall of the breech external portion 21, such that the spring retainer 13 is fitted in the lower hole of the breech external portion 21.

The diameter of the inner end portion 132 of the spring retainer 13 is equal to the diameter of the lower hole of the breech external portion 21, the depth of the inner end portion 132 of the spring retainer 13 is equal to the thickness of the wall of the breech external portion 21, thus that the inner end portion 132 of the spring retainer 13 is fitted in the lower hole of the breech external portion 21 and flush the inner wall of the breech external portion 21 when the spring retainer 13 is pushed by the push button 11 through the return spring 12.

When the spring 12 is compressed by the push button 11, the upper end of the steel rod 14 protrudes from the upper hole of the breech external portion 21, the slide 15 can then engage with the upper end of the steel rod 14, when the pressure on the push button 11 is removed, the return spring 12 bias the push button 11 in a downward direction, the steel rod 14 will drag the slide 15 downward to engage with the breech.

The diameter of the inner end portion 152 of the slide 15 is equal to the diameter of the upper hole of the breech external portion 21 and the diameter of the bores of the breech internal portion 22, the depth of the inner end portion 132 of the slide 13 has a size that can engage the breech external portion 21 with the breech internal portion 22. For example, the depth of the inner end portion 132 of the slide 13 can be equal to the sum of the thickness of the wall of the breech external portion 21 and width of the breech internal portion 22. Since the diameter of the inner end portion 132 of the slide is equal to the diameter of the upper hole of the breech external portion 21 and the diameter of the bores of the breech internal portion 22, when the slide 15 goes through the breech external portion 21 and into the breech internal portion 22, the slide 15 can limit radial direction movement between the breech external portion 21 and the breech internal portion 22 and prevent the breech from opening. When the assembly is installed in the breech it bisects the outer breech that's hinged and the inner breech holding it closed in its default position.

Figure 8:
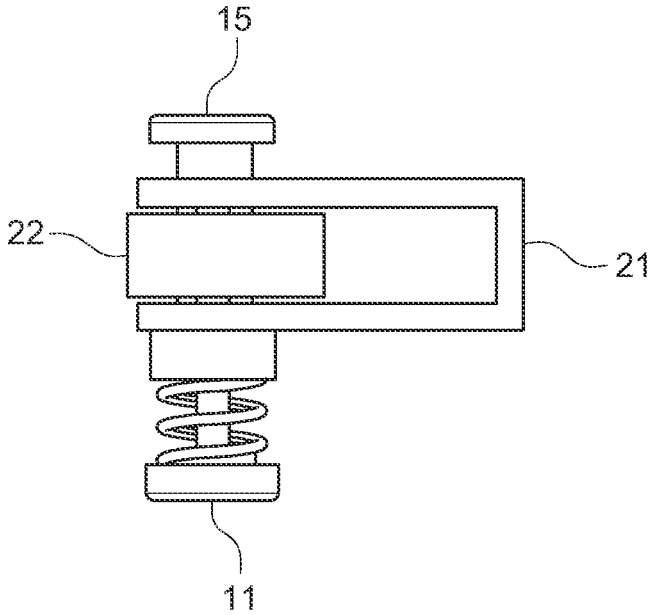
FIG. 8 illustrates a prospective view of the breech release when the breech is opened.
Figure 9:
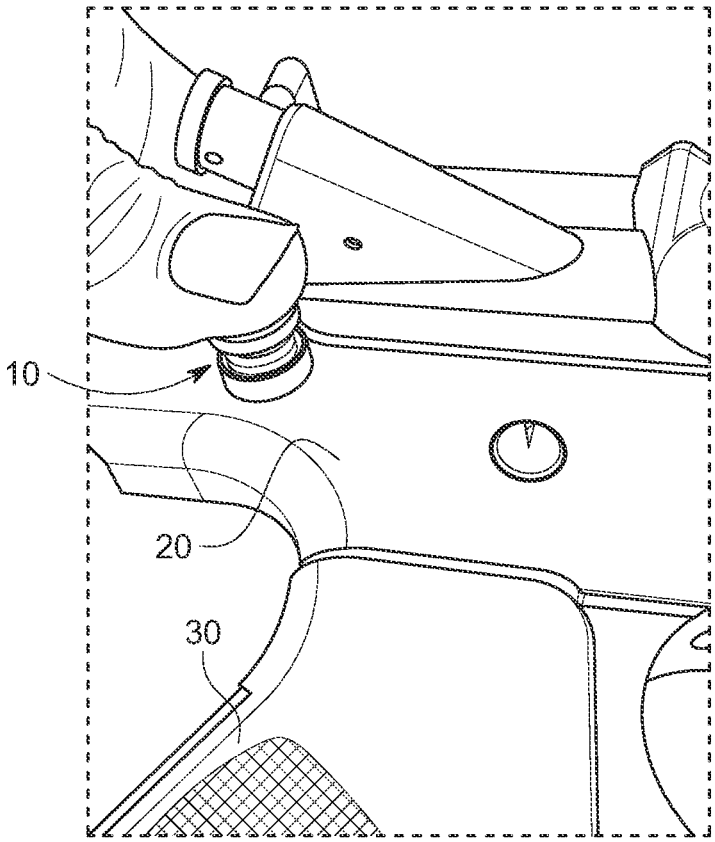
FIG. 9 illustrates the button being depressed, moving the slide out of the inner breech allowing the breech to open slightly.

Referring FIGS. 8-9, when the push button 11 is depressed it moves the slide 15 out of the breech internal portion 22, in this case, it is the steel rod 14 not the slide 15 located in the bores of the breech internal portion 22, since the diameter of the steel rod 13 is smaller than that of bores of the breech internal portion 22, the steel rod 14 can move relative to the radial direction of the bores of the breech internal portion 22, causing radial direction movement between the breech external portion 21 and the breech internal portion 22 and allowing the breech to open slightly, which makes a firearm in an inoperable state and allows the magazine 30 to be released.

After the magazine is released and another magazine is loaded, the breech external portion 21 and the breech internal portion 22 are aligned and the return spring 12 will bias the push button 11 in a downward direction, the steel rod 14 will drag the slide 15 downward to engage with the breech and hold it closed in its default position, which makes the firearm restore to operable state.

The invention claimed is:

1. A breech release for a shotgun comprising:

a push button, a spring retainer, a return spring located between the push button and spring retainer, a release slide;

a threaded steel rod passing through the return spring and the spring retainer to connect the push button and the release slide;

wherein the breech release engages a breech external portion and a breech internal portion of a breech between the spring retainer and the release slide.

2. The breech release of claim 1, wherein the release slide has a stepped cylindrical bolted structure.

3. The breech release of claim 1, wherein the spring retainer has a stepped cylindrical structure.

4. The breech release of claim 1, wherein the return spring biases the slide which bisects the breech external portion hinged the breech internal portion, holding the breech closed in its default position.

5. The breech release of claim 1, when the push button is depressed, the push button moves the release slide out of the breech internal portion, allowing the breech to open.

6. The breech release of claim 5, wherein the breech is open, a magazine is to be released for a shotgun.

* * * * *